US008402956B2

(12) United States Patent
Dakan et al.

(10) Patent No.: US 8,402,956 B2
(45) Date of Patent: Mar. 26, 2013

(54) DOUBLE BARREL TOY LAUNCHER APPARATUS

(75) Inventors: Kevin C. Dakan, Warwick, RI (US); Raymond Aaron Mead, Pawtucket, RI (US); Brian Jablonski, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 279 days.

(21) Appl. No.: 12/853,463

(22) Filed: Aug. 10, 2010

(65) Prior Publication Data

US 2012/0037135 A1 Feb. 16, 2012

(51) Int. Cl.
*F41B 7/08* (2006.01)

(52) U.S. Cl. ..... 124/27

(58) Field of Classification Search ..... 124/26, 124/27, 28, 66

See application file for complete search history.

(56) References Cited

U.S. PATENT DOCUMENTS

| | | | | | |
|---|---|---|---|---|---|
| 183,124 | A | * | 10/1876 | Butterweck | 124/27 |
| 409,017 | A | | 8/1889 | Comstock | |
| 522,464 | A | | 7/1894 | Fox | |
| 532,090 | A | | 1/1895 | Park | |
| 961,511 | A | | 6/1910 | Marble | |
| 1,114,610 | A | * | 10/1914 | Hawthorne | 124/27 |
| 1,633,795 | A | * | 6/1927 | Schmidt | 124/27 |
| 2,106,400 | A | * | 1/1938 | Brethen et al. | 124/27 |
| 3,465,744 | A | | 9/1969 | Nielsen | |
| 4,774,929 | A | | 10/1988 | Milliman | |
| 5,529,050 | A | | 6/1996 | D'Andrade | |
| 6,598,329 | B1 | | 7/2003 | Alexander | |
| 7,287,526 | B1 | | 10/2007 | Bligh et al. | |
| 7,418,797 | B1 | | 9/2008 | Crose | |
| 7,437,847 | B1 | | 10/2008 | Mabry | |
| 7,552,557 | B1 | | 6/2009 | Mabry | |
| 2006/0242880 | A1 | | 11/2006 | Griffin | |

OTHER PUBLICATIONS

Double Shot product and packaging, Copyright 2006 by Buzz Bee Toys (2006).

* cited by examiner

*Primary Examiner* — John Ricci
(74) *Attorney, Agent, or Firm* — Perry Hoffman

(57) ABSTRACT

A toy launcher apparatus for discharging soft foam projectiles, the apparatus having a housing and a barrel assembly, including side-by-side barrels, that simulates a real double barrel shotgun. Within the housing are two launching assemblies operatively connected to the barrels, and a trigger assembly for capturing launching tubes of the launching assemblies and for allowing a user to release the launching tubes, and launching springs mounted around the launching tubes to cause the projectiles to be "fired" when the launching tubes are released. Also mounted to the housing and the barrel assembly, and operatively connected to the launching assemblies, is a cocking assembly having an elongated link pivotally connected at one end to the barrel assembly and at an opposite end to a ratchet and compression mechanism. The ratchet and compression mechanism includes a central block with an upward extending arm for engaging the launching tubes to compress the launching springs, and a downward extending arm for engaging a rack connected to an inner frame of the housing to prevent the launching springs, when partially compressed, from snapping to an expanded position should the user fumble the apparatus during a cocking cycle. The barrel assembly is rotatable between a housing aligned position and a housing nonaligned position. The barrel assembly also includes a slide collar for facilitating sliding the barrels between an extended position and a retracted position when the barrel assembly is in the housing aligned position.

20 Claims, 16 Drawing Sheets

DOUBLE BARREL TOY LAUNCHER APPARATUS

FIELD OF THE INVENTION

The present invention relates generally to a toy launcher apparatus, and, more particularly, to a toy launcher apparatus that simulates a double-barrel shotgun, where "breaking" the barrels safely cocks the launcher apparatus and allows soft foam toy projectiles to be loaded.

BACKGROUND OF THE INVENTION

Toys are often designed to have play value by simulating a real object. Toy guns and rifles have been marketed for decades and include such devices as water pistols and rifles, cap guns, BB guns and rifles, dart guns and NERF brand launchers that discharge a soft foam toy dart or projectile. It is desirable to simulate a double barrel shotgun in a toy but doing so in a successful manner has proven difficult.

Double barrel shotguns are well known and are disclosed in several existing patents. By way of example, U.S. Pat. No. 409,017 for a "Breech Loading Gun" issued in 1889 to Comstock, and purports to disclose a shotgun having a top lever for releasing barrels allowing them to pivot by gravity. Using additional levers and springs, shells are removed, new shells loaded and the gun is cocked, all in a compact and inexpensive manner. U.S. Pat. No. 522,464 for a "Breech Loading Breakdown Gun" issued in 1894 to Fox, purports to disclose a shotgun using a sliding lock bolt and springs whereupon pivoting the barrel of the gun causes automatic cocking of a hammer where all of the mechanisms are internally located. Another U.S. Pat. No. 532,090 for a "Cocking Mechanism For Breakdown Guns" issued in 1895 to Park, also purports to disclose a mechanism for automatically cocking the hammers of a shotgun by tipping the barrels.

Toy guns have also been patented. For example, U.S. Pat. No. 3,465,744 for a "Toy Double-Barreled Shotgun" issued in 1969 to Nielsen, purports to disclose a toy shotgun using spring loaded cartridges that are loaded into the rear opening of each barrel and projectiles in the cartridges are released by a trigger mechanism having two elements for releasing each cartridge sequentially by one continuous stroke of the trigger. U.S. Pat. No. 4,774,929 for a "Gun With Pivoting Barrel And Lever For Retaining Barrel In Position Or Permitting Barrel To Pivot" issued in 1988 to Milliman, and purports to disclose an air gun with a pivoting barrel and a cocking and retaining lever. When the lever is pivoted to unlock the barrel, the barrel pivots automatically to a loading position and the lever cocks the hammer. When the barrel is loaded, the barrel is pivoted back by the user to a firing position and the lever is moved to a barrel retaining position. Reference is also made to a toy having a double barrel arrangement that is pivoted to allow darts to be loaded, each dart mounted to a plastic shell with a hole in its base. A release lever allows the gun to open so that the dart/shell combinations may be loaded. Pivoting the double barrel arrangement cocks a pair of spring-loaded pistons and pulling the trigger fires one dart and a further harder pull fires the second dart. The shells remain in the barrels and springs in the barrels that are compressed when the shells are loaded, cause the shells to be ejected the next time that the double barrel arrangement is pivoted.

These patents and devices are of some interest, however, they do not disclose or illustrate a superior marketable toy item.

SUMMARY OF THE INVENTION

In accordance with the present invention, an advantageous method and apparatus are provided in the form of a toy launcher apparatus that simulates a double barrel shotgun. The launcher apparatus operates without a motor or batteries, but instead, mimicking a real double barrel shotgun, the toy launcher apparatus "breaks" for loading. The toy launcher apparatus of the present invention discharges soft foam toy projectiles or darts and operates to cock the apparatus at the same time as the apparatus is opened to allow loading of projectiles. The described embodiment includes side-by-side double barrels pivotally mounted to a housing, and a link pivotally mounted at one end to a barrel assembly that includes the barrels, and at the other end, the link is pivotally connected to a ratchet and compression mechanism. The barrel assembly pivots to open the barrels for loading one or two projectiles and this movement also moves the link to cock a launching spring. The ratchet portion of the ratchet and compression mechanism is a safety feature to prevent a partially compressed launching spring from inadvertently snapping back should a user loose his grip on the launcher apparatus during the cocking procedure, or in any other way should he fumble the launcher apparatus.

The barrel assembly with the barrels is also a feature in that the barrel assembly is able to pivot to cause cocking of the apparatus, and the barrels are also able to slide back and forth to operate certain other elements, such as a lock mechanism to secure the barrel assembly to the housing. The launcher apparatus also has the advantages of being relatively simple, easy to operate, fun to use, safe, relatively inexpensive, compact and yet, structurally robust.

Briefly summarized, the invention relates to a toy launcher apparatus including a housing, a barrel assembly pivotally mounted to the housing, the barrel assembly having two adjacent barrels with each barrel enabled to receive a toy projectile, the barrel assembly being rotatable between a housing aligned position and a housing nonaligned position, a slide collar connected to the barrels, the barrels being movable relative to the slide collar between a retracted position and an extended position when the barrel assembly is in the housing aligned position, a launching assembly connected to the barrel assembly, the launching assembly including a launching spring, a trigger assembly mounted to the housing and connected to the launching assembly, the trigger assembly having structure to capture and release the launching assembly, a ratchet and compression mechanism mounted to the housing, and a cocking assembly connected to the barrel assembly and to the launching assembly, the cocking assembly using the ratchet and compressing mechanism to safely compress the launching spring of the launching assembly to enable the toy projectiles to be discharged from the barrels.

The invention also relates to a method for manufacturing the toy launcher apparatus including the steps of forming a gun simulating housing with an inner frame, pivotally mounting a barrel assembly to the housing, the barrel assembly being movable between a housing aligned position and a housing nonaligned position, slidably mounting multiple barrels of the barrel assembly to a slide collar, the barrels being movable between a retracted position and an extended position when the barrel assembly is in the housing aligned position, installing a launching assembly to the inner frame of the housing operatively connected to the multiple barrels, the launching assembly including a launching tube and a launching spring, connecting a trigger assembly to the housing located to capture and release the launching tube and the launching spring, installing a ratchet and compression mechanism to the inner frame in the housing, and mounting a cocking assembly to the housing, the cocking assembly including the ratchet and compression mechanism, and being pivotally connected to the barrel assembly and to the ratchet and compression mechanism, the cocking assembly movable to safely compress the launching spring.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
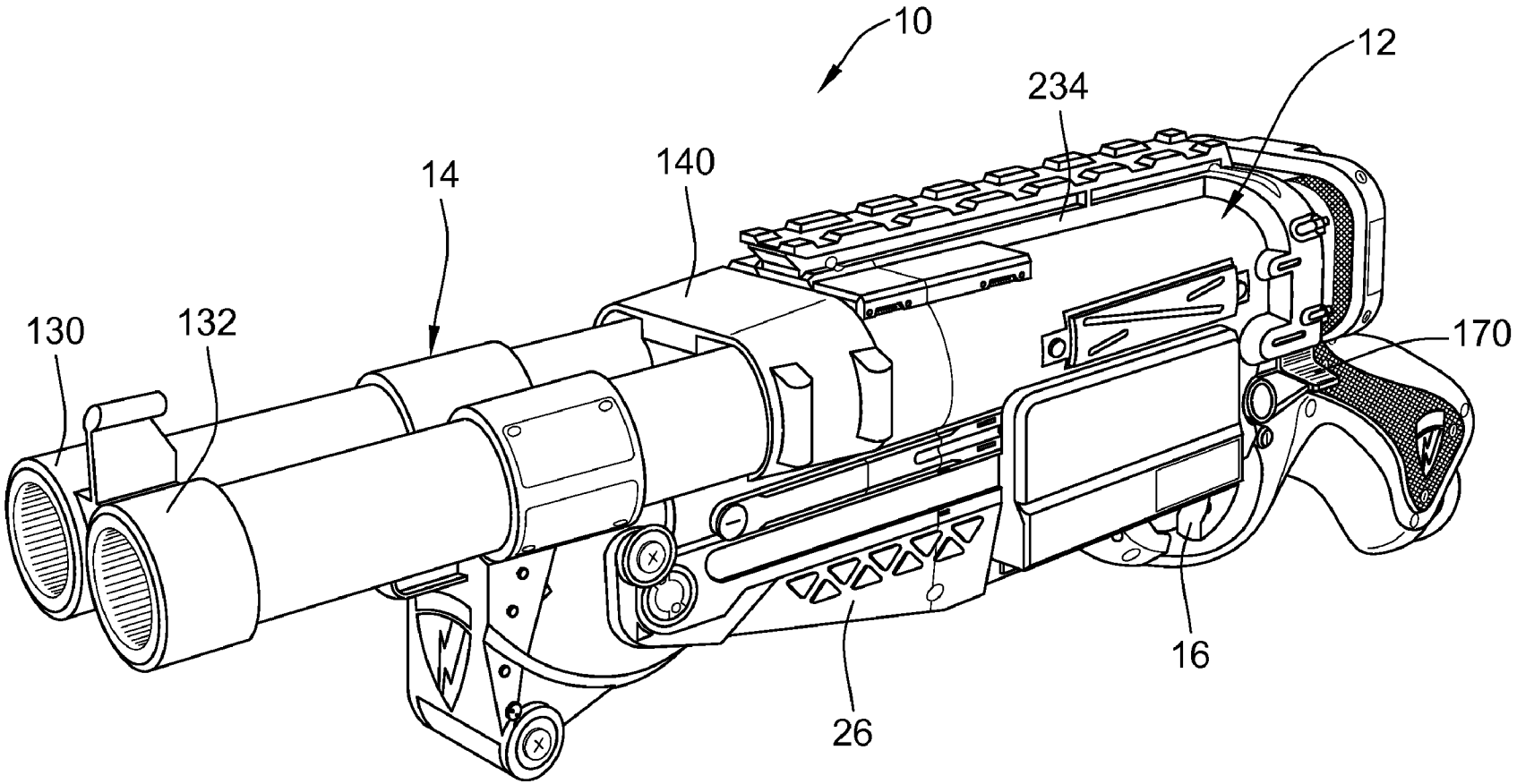
FIG. 1 is a front isometric view of a preferred embodiment of the present invention in the form of a toy launcher apparatus that simulates a double barrel shotgun.
Figure 2:
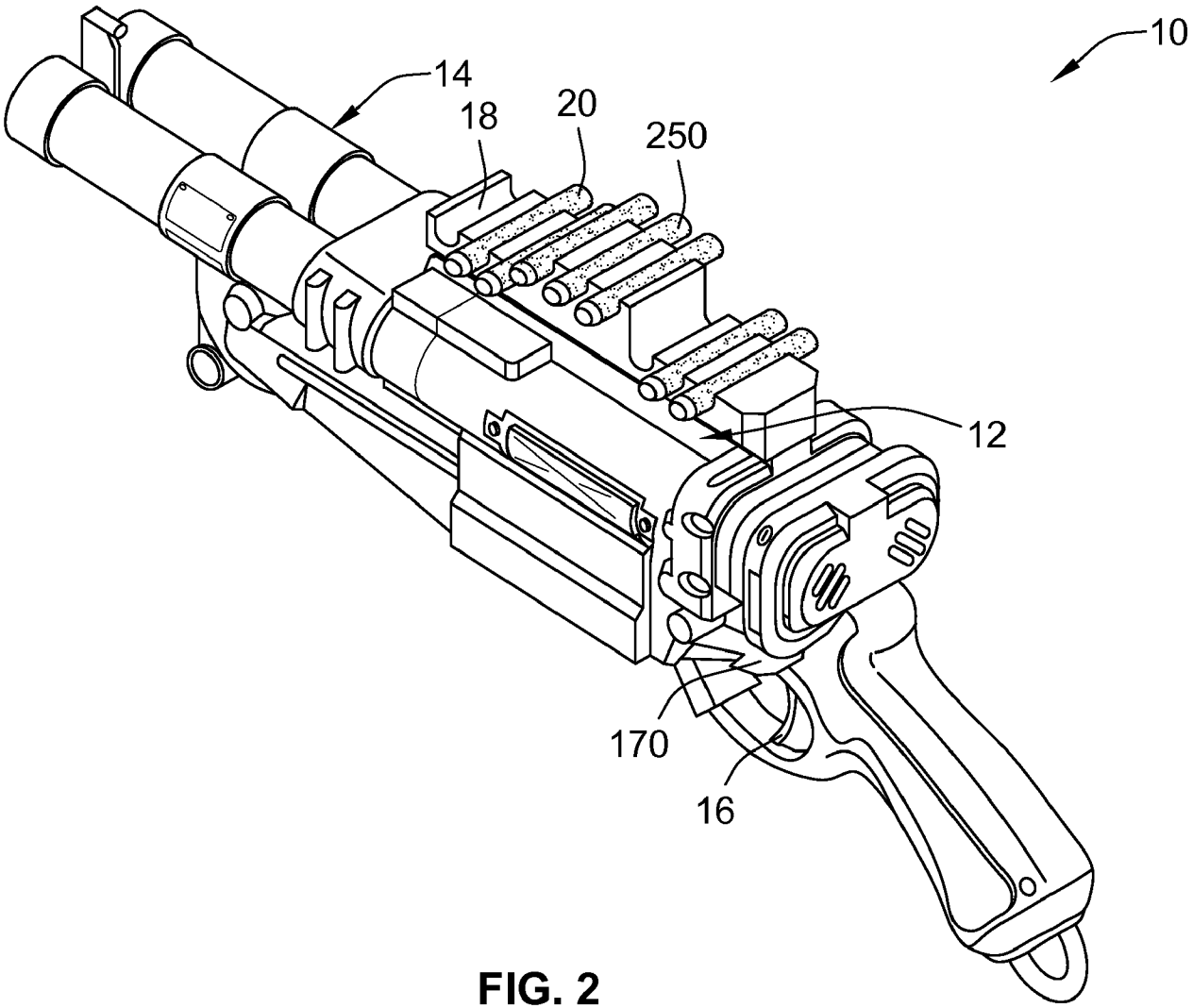
FIG. 2 is a rear isometric view of the toy launcher apparatus shown in FIG. 1, to which is mounted a projectile carrier.
Figure 3:
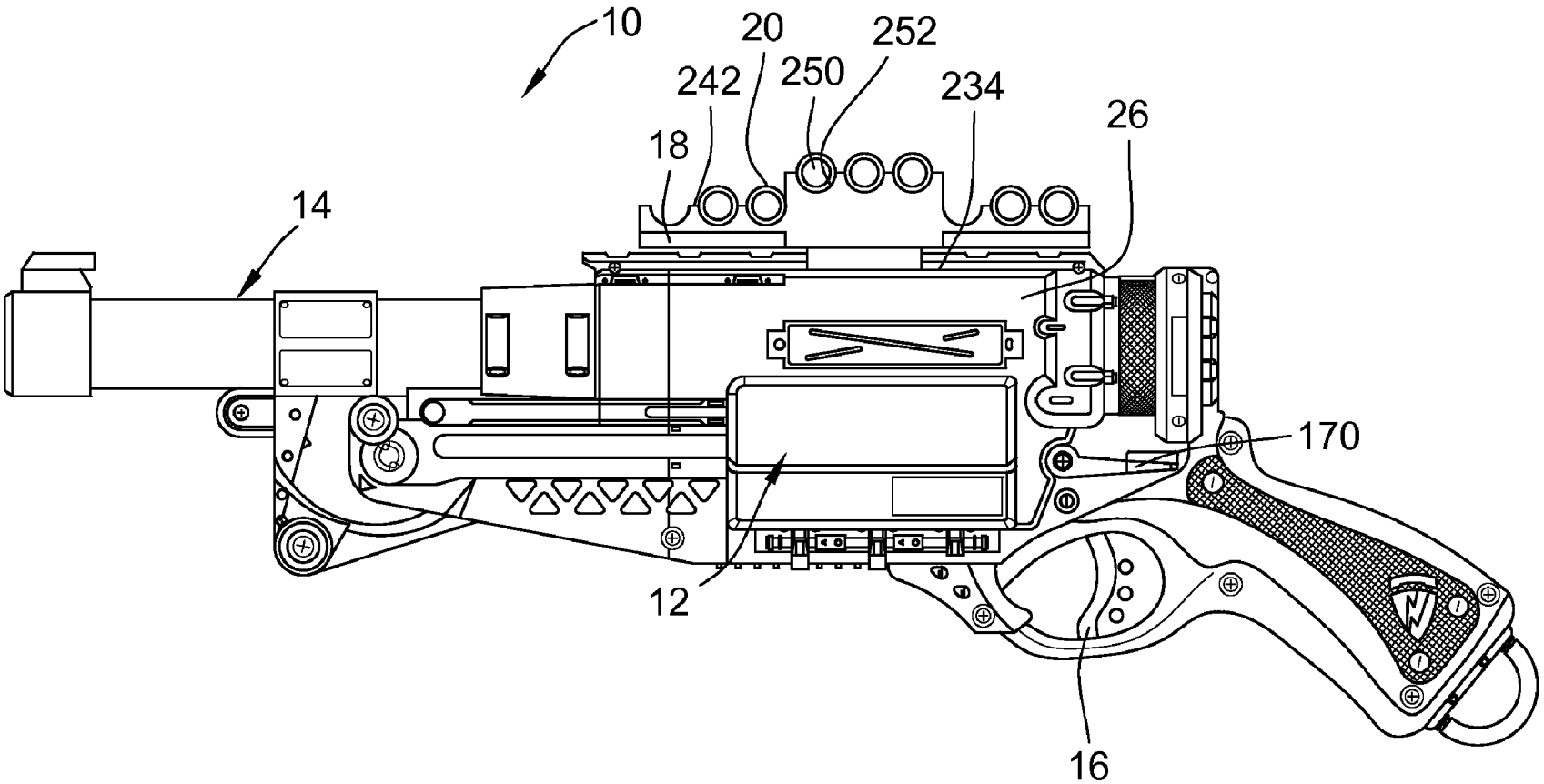
FIG. 3 is a side elevation view of the toy launcher apparatus and the projectile carrier shown in FIG. 2.

Referring now to the Figures, FIGS. 1-3, there is shown an embodiment of the invention in the form of a toy launcher apparatus 10 configured as a stylized double barrel shotgun. The toy launcher apparatus 10 includes a housing 12, a barrel assembly 14 mounted to a forward portion of the housing, and a trigger assembly 16 mounted mostly in the housing. Mounted to the toy launcher apparatus along an upper portion of the housing 12, is a projectile carrier 18, FIGS. 2 and 3, featuring seven darts or projectiles, such as the projectile 20, of the type that may be discharged or "fired" from the toy launcher apparatus 10. In the alternative, other types of projectiles may be used with the toy launcher apparatus 10 including those with enlarged head portions. Also in the alternative, the carrier may be configured differently as may the configuration of the housing. For example, the projectile carrier may be configured as a circular canister or have a double deck design, and the housing may be modeled after any other real weapon and/or have indicia of a popular merchandising concept.

Throughout this disclosure, words such as "forward", "rearward", "upper", "lower", "front", and "rear", as well as like terms, refer to portions of the toy launcher apparatus as they are viewed in the drawings relative to other portions or in relationship to the positions of the apparatus as it will typically be held and moved during play when operated by a user.

Figure 4:
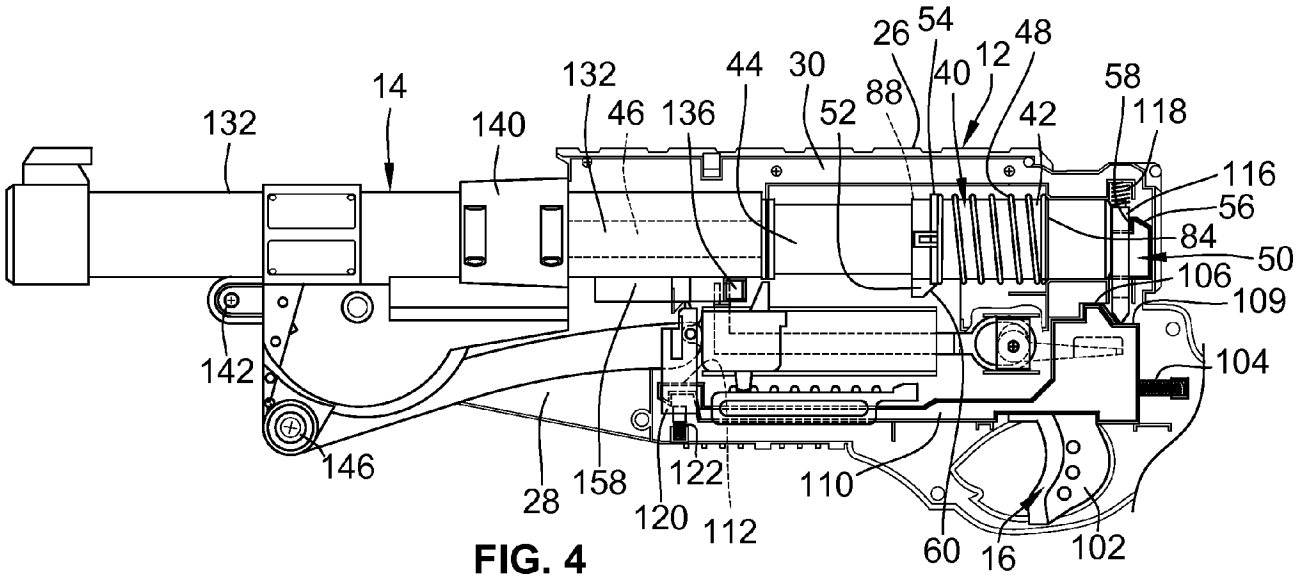
FIG. 4 is a partial side elevation view of the interior of the toy launcher apparatus shown in FIG. 1, illustrating a launching assembly in a fully cocked, ready-to-fire configuration and barrels in a retracted position.
Figure 5:
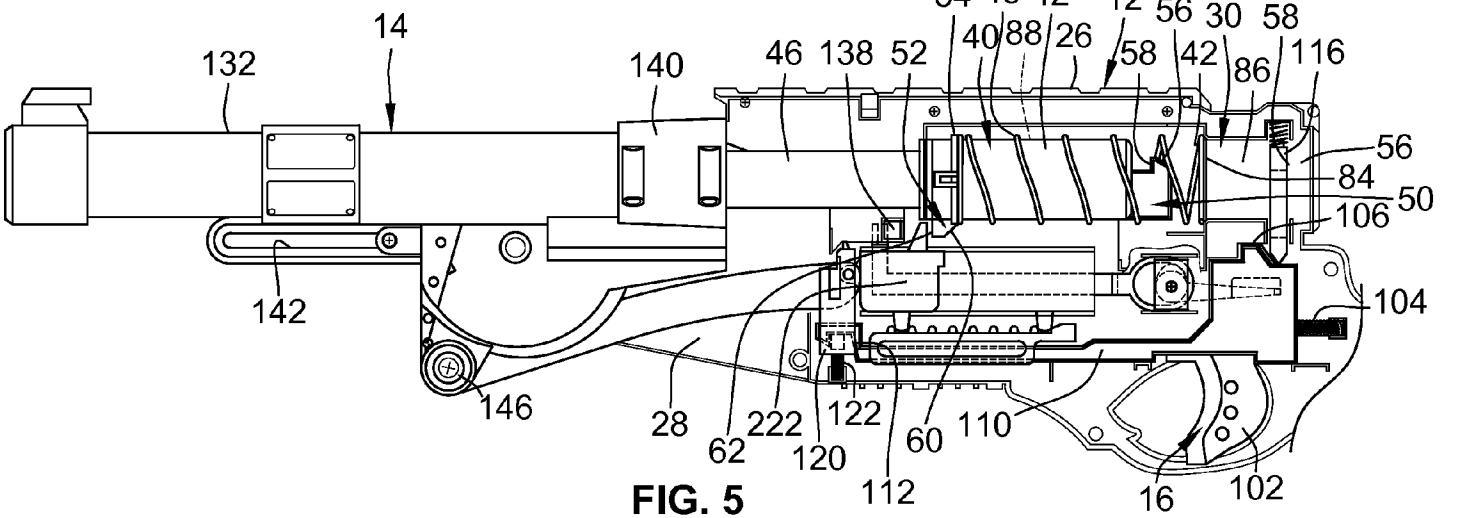
FIG. 5 is a partial side elevation view of the interior of the toy launcher apparatus like that shown in FIG. 4, illustrating the launching assembly in a relaxed configuration and the barrels in an extended position.

The housing 10 includes an outer portion 26, FIG. 1, and an inner portion 28, FIG. 4, having frame members, such as the frame member 30, which will be disclosed in more detail below. A launching assembly 40, FIGS. 4-7 and 12, is mounted to the frame member 30 and the frame member 30 is fastened to the housing 12, such as by a screws, exemplified by a screw 41. The launching assembly 40 includes a rear located launching tube 42, a mid located inner tube 44, a forward located breech tube 46, and a launching spring 48. The launching tube 42 includes a rear hook 50, a front tab 52, and a front flange 54, and is movable by sliding over the inner tube 44 between a forward or relaxed position as shown in FIG. 5, and a rearward or cocked position as shown in FIG. 4. The launching tube rear hook 50 includes a cam surface 56 and an abutment surface 58. The launching tube front tab 52 also includes a cam surface 60 and an abutment surface 62.

Figure 6:
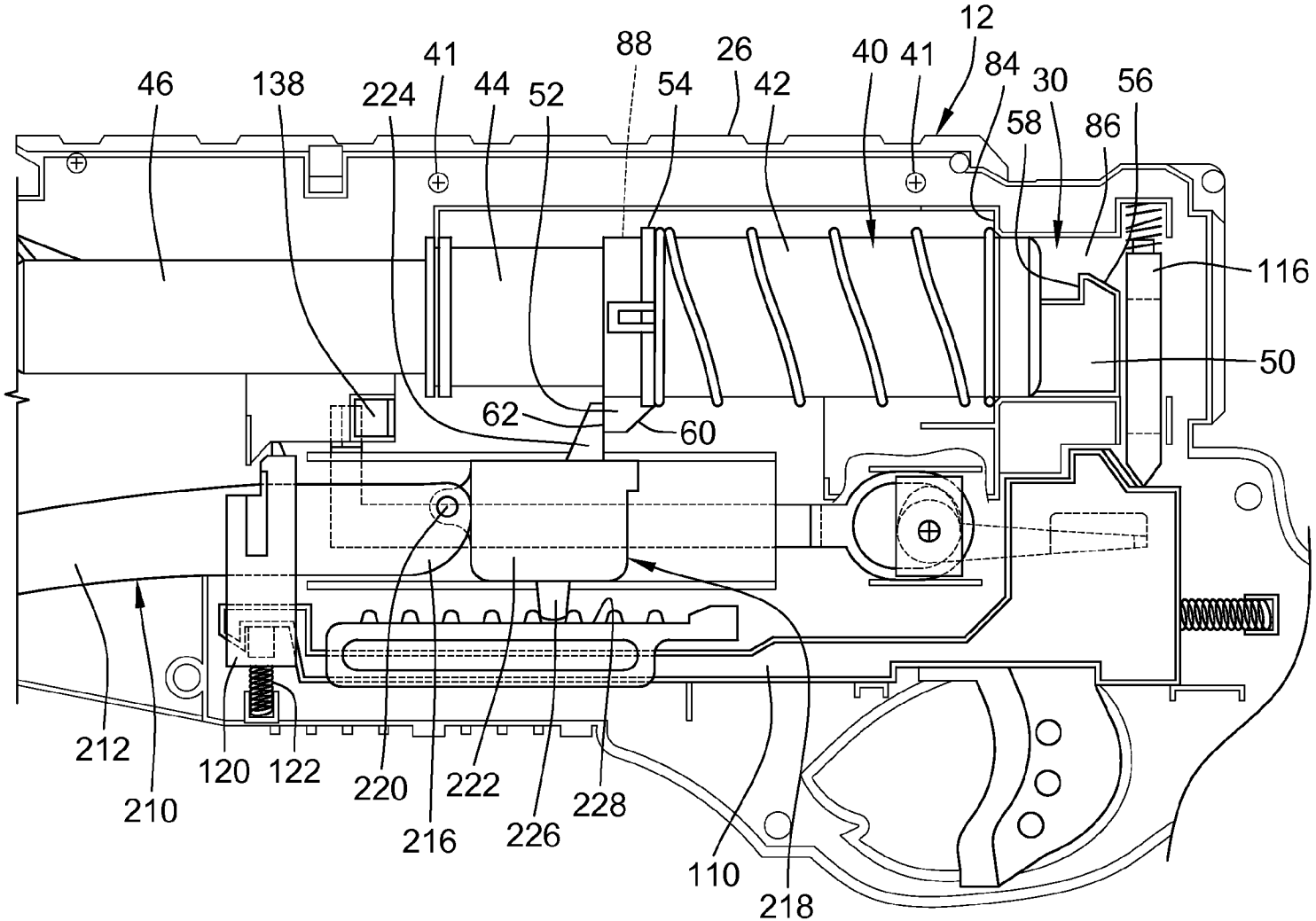
FIG. 6 is an enlarged side elevation view of a portion of the toy launcher apparatus illustrating the launching assembly in a partially cocked position and a ratchet and compression mechanism.
Figure 7:
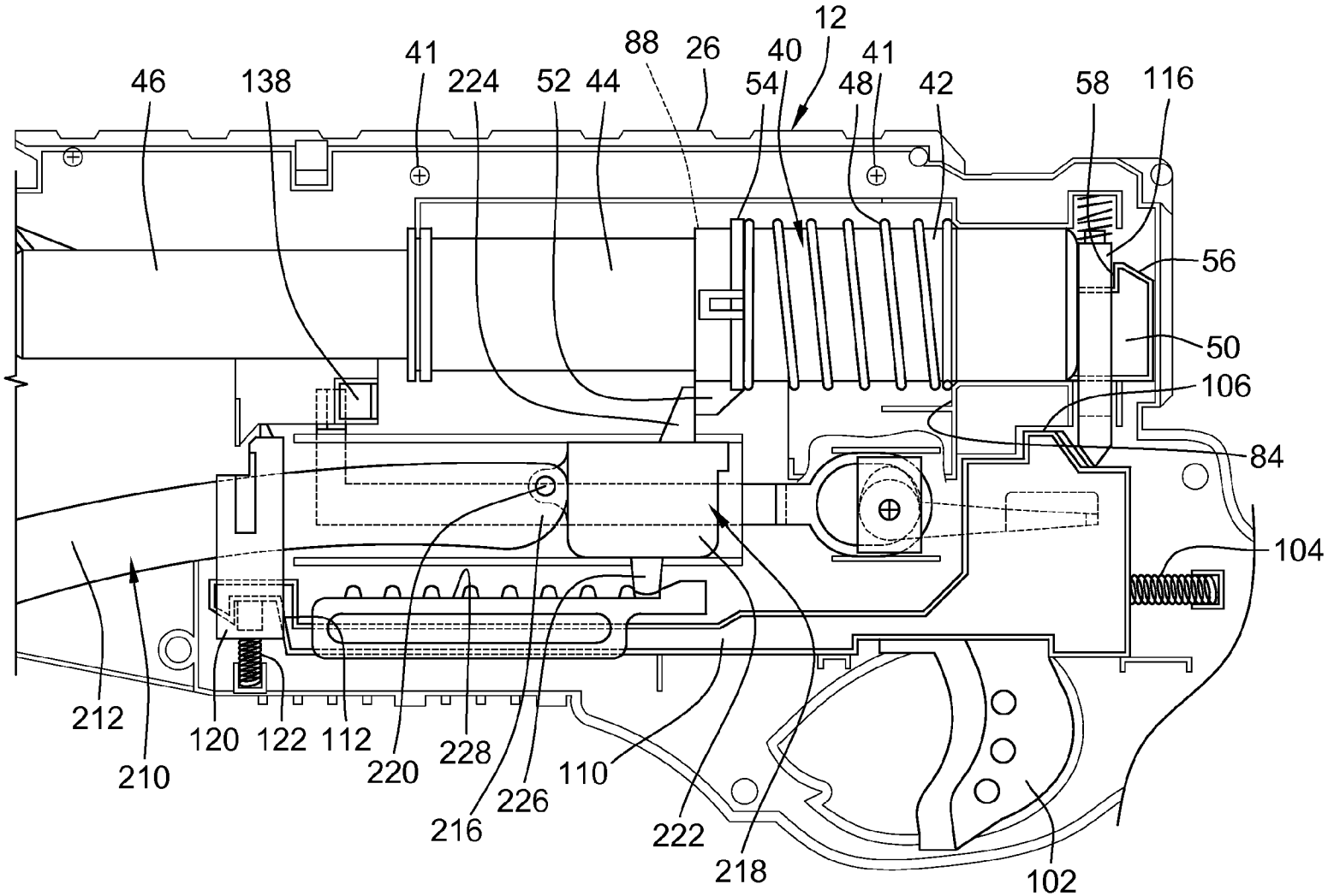
FIG. 7 is a side elevation view like that shown in FIG. 6, illustrating the launching assembly in a cocked position but before the barrels are placed in a retracted position.
Figure 11:
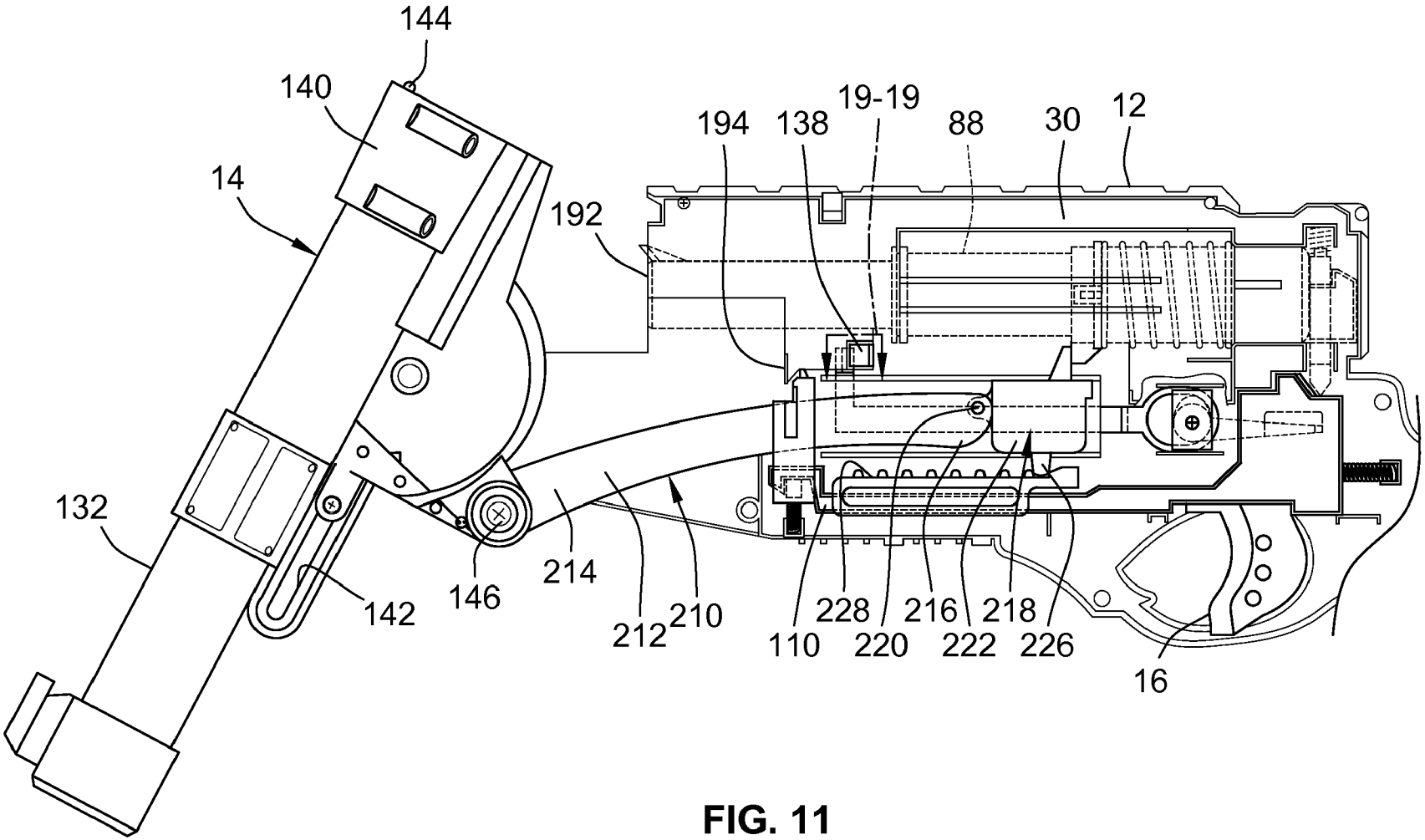
FIG. 11 is a side elevation view of the barrels in a housing nonaligned position, and illustrating a second launching assembly in a cocked position shown in dotted lines with the first launching assembly removed.
Figure 12:
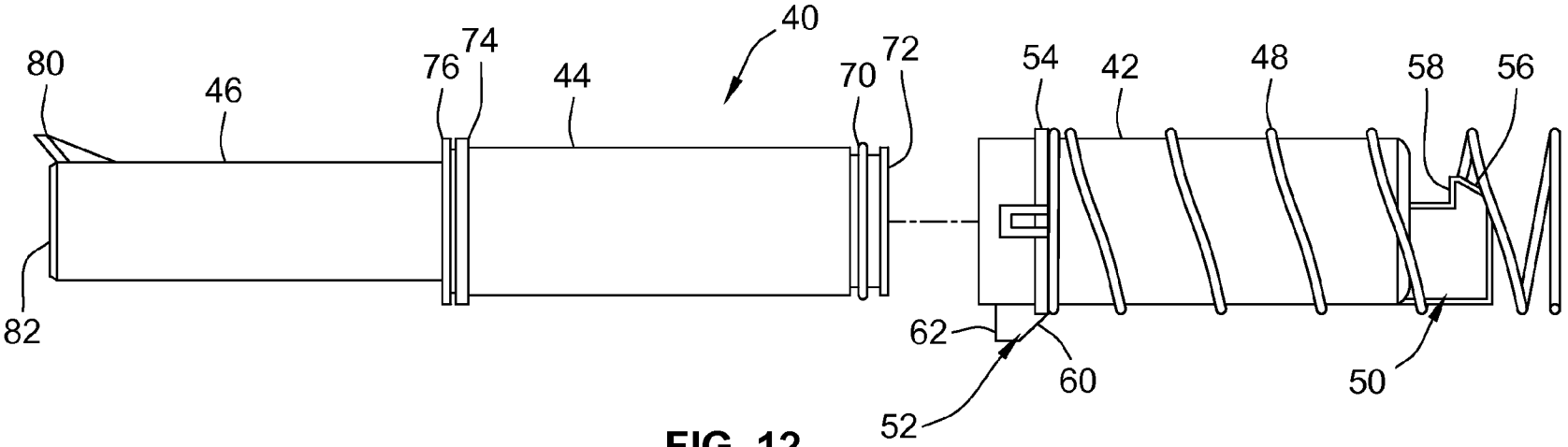
FIG. 12 is an enlarged exploded side elevation view of the launching assembly.
Figure 14:
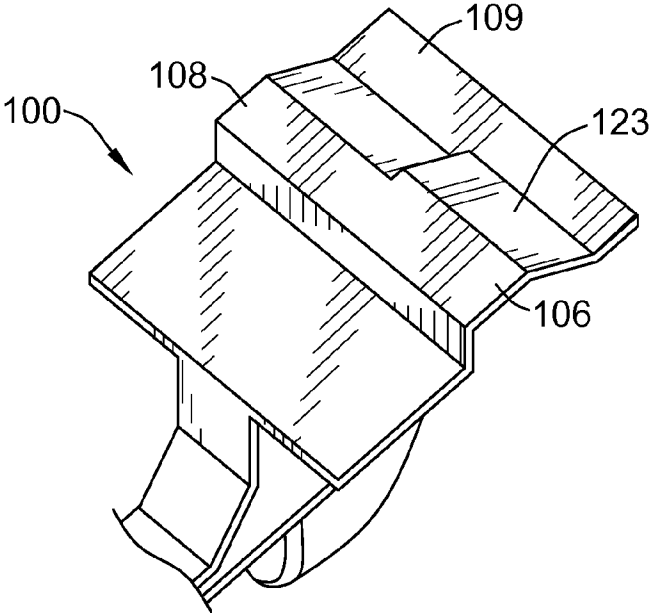
FIG. 14 is an enlarged, downward looking isometric view of cam surfaces of the portion of the trigger assembly shown in FIG. 13.
Figure 13:
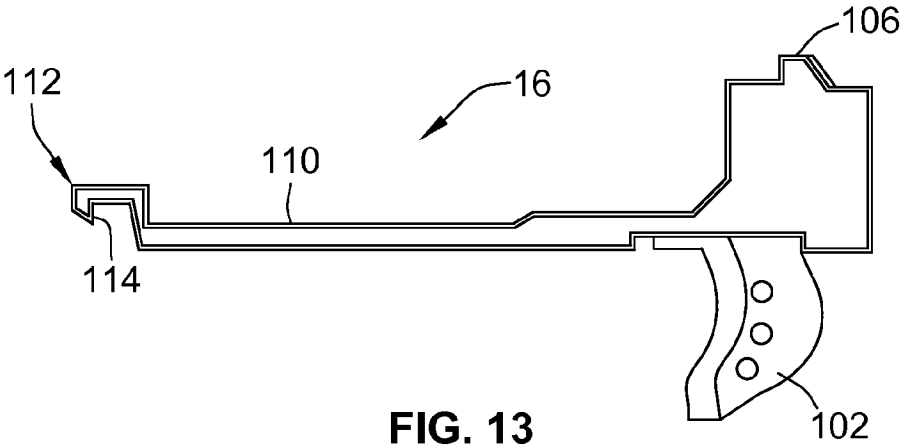
FIG. 13 is an enlarged side elevation view of a portion of a trigger assembly.

The inner tube 44 is mounted to be stationary in the housing 12 and includes an o-ring 70, FIG. 12, at a rearward open end portion 72 and two mounting flanges 74, 76 at a forward end portion 78. The breech tube 46 is also mounted to be stationary within the housing 12 and includes an upper tab 80 at a forward end 82 to align with the barrel assembly. The breech tube 46 may be made integral with the inner tube 44. The launching spring 48 is positioned around the launching tube 42 and is restrained between the launching tube front flange 54 and a flange 84, FIGS. 6 and 7, of the frame member 30, and is configured to move between an expanded or relaxed position as shown in FIG. 5, and a compressed or cocked position as shown in FIGS. 4 and 7. Rearward of the frame member flange 84 is a space 86 in the housing 12 for receiving the launching tube 42 when, during cocking of the toy launcher apparatus, the launching tube is pushed rearward to its cocked position as shown in FIG. 7. When the toy launcher apparatus 10 is cocked, the launching spring 48 is compressed between the flange 54 and the flange 84 and is also shown in FIG. 6. The tubes 42, 44, 46 may be made of any suitable plastic and the launching spring 48 may be made of any suitable metal. It is noted that an identical second launching assembly 88, FIG. 11, shown in dotted lines, including a launching tube, an inner tube, a breech tube, and a launching spring, is located parallel to the launching assembly 40 and these tubes, identical in structure to the tubes of the launching assembly 40, but are mounted to the opposite side of the frame member 30.

The trigger assembly 16, FIGS. 4, 5, 13 and 14, includes a trigger 102, a trigger spring 104, two raised trigger cam surfaces 106, 108, a rear support surface 109, a forward extending arm 110, a front hook 112 having an abutment surface 114, a rear latch ring 116, FIGS. 4-7 and 15, a rear latch spring 118, a front latch ring 120, and a front latch spring 122. The rear latch ring 116 is mounted to the frame member 30 and is biased downward by the rear latch springs 118 against the trigger support surface 109 when the toy launcher apparatus is relaxed as shown in FIG. 5. During cocking, the cam surface 56, FIGS. 4, 5 and 15, of the launching tube hook 50 pushes against the rear latch ring 116 causing the rear latch ring 116 to be moved upward to compress the rear latch spring 118. Once the cam surface 56, of the launching tube hook 50 passes the rear latch ring 116, the rear latch spring 118 causes the rear latch ring to snap downward and capture the launching tube 42 in the rearward position by engaging the abutment surface 58 of the launching tube hook 50 with the rear latch ring 116, as shown in FIGS. 4, 7 and in dotted lines in FIG. 15, thus cocking the launching apparatus. It is noted that a second rear latch ring and a second rear latch ring spring are located to the opposite side of the frame 30 as shown in dotted lines in FIG. 11. The rear latch ring and the rear latch spring are identical to the rear latch ring 116 and the rear latch ring spring 118.

There are two trigger cam surfaces, two rear latch rings and two rear latch springs, one for engaging each of the launching assemblies 40, 88. As may be seen in FIG. 14, the raised trigger cam surfaces 106, 108 are slightly offset from one another, so that when pulling on the trigger 102 to release the respective latch rings, projectiles in the launching assemblies are launched sequentially and not simultaneously, although when the trigger is pulled fast enough the projectiles launch nearly simultaneously. Because the cam surface 106 is longer, it releases its respective rear latch ring slightly before the cam surface 108 releases its respective rear latch ring. If the trigger 102 is pulled partially, one projectile may be launched, but not the second projectile, which may be launched at another time with a full pull of the trigger.

Figure 15:
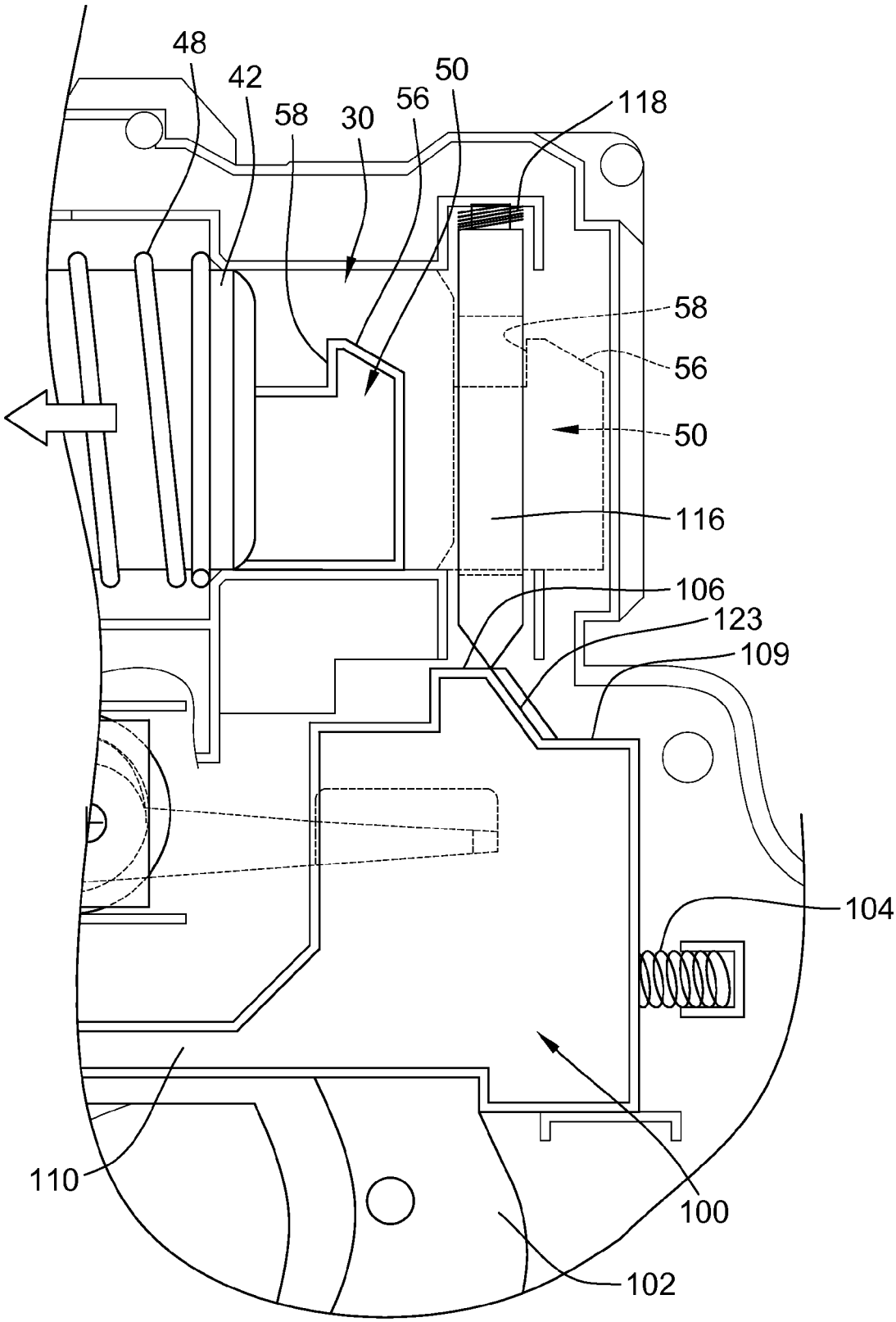
FIG. 15 is an enlarged partial elevation view of another portion of the trigger assembly.

The trigger assembly 16 is movable between forward and rearward positions. The forward position is shown in FIGS. 4 and 5, and the rearward position is shown in FIG. 15, where the launching tube 42 has been released and is being pushed forward by the launching spring 48 as shown by an arrow causing the toy launcher apparatus to discharge a projectile. When the trigger is pulled rearward a sloped surface 123 moves the rear latch ring 116 upward until the rear latch ring is engaged by the cam surface 106. The rear latch spring 118 becomes compressed, as does the trigger spring 104. In the raised position the rear latch ring releases the launching tube hook 50 and the launching spring quickly pushes the launching tube forward. The trigger spring 104 biases the trigger assembly to the forward position as soon as the user releases the trigger 102. The trigger assembly front hook 112 locks the trigger assembly during loading and cocking of the toy launcher apparatus because the front latch ring 120 moves vertically between upper and lower positions and the front latch spring 122 biases the front latch ring 120 upward. Locking of the trigger 102 occurs when the front latch ring 120 in the upper position and engages the front hook abutment surface 114 as shown in FIGS. 5-7. When the barrel assembly 14 is fully cocked and the barrels moved to the retracted position, the front latch ring 120 is forced downward against the front latch spring 122 causing the front hook 112 of the trigger assembly to be disengaged from the front latch ring 120 thereby freeing the trigger 102 to be activated by the user as shown in FIG. 4.

Figure 8:
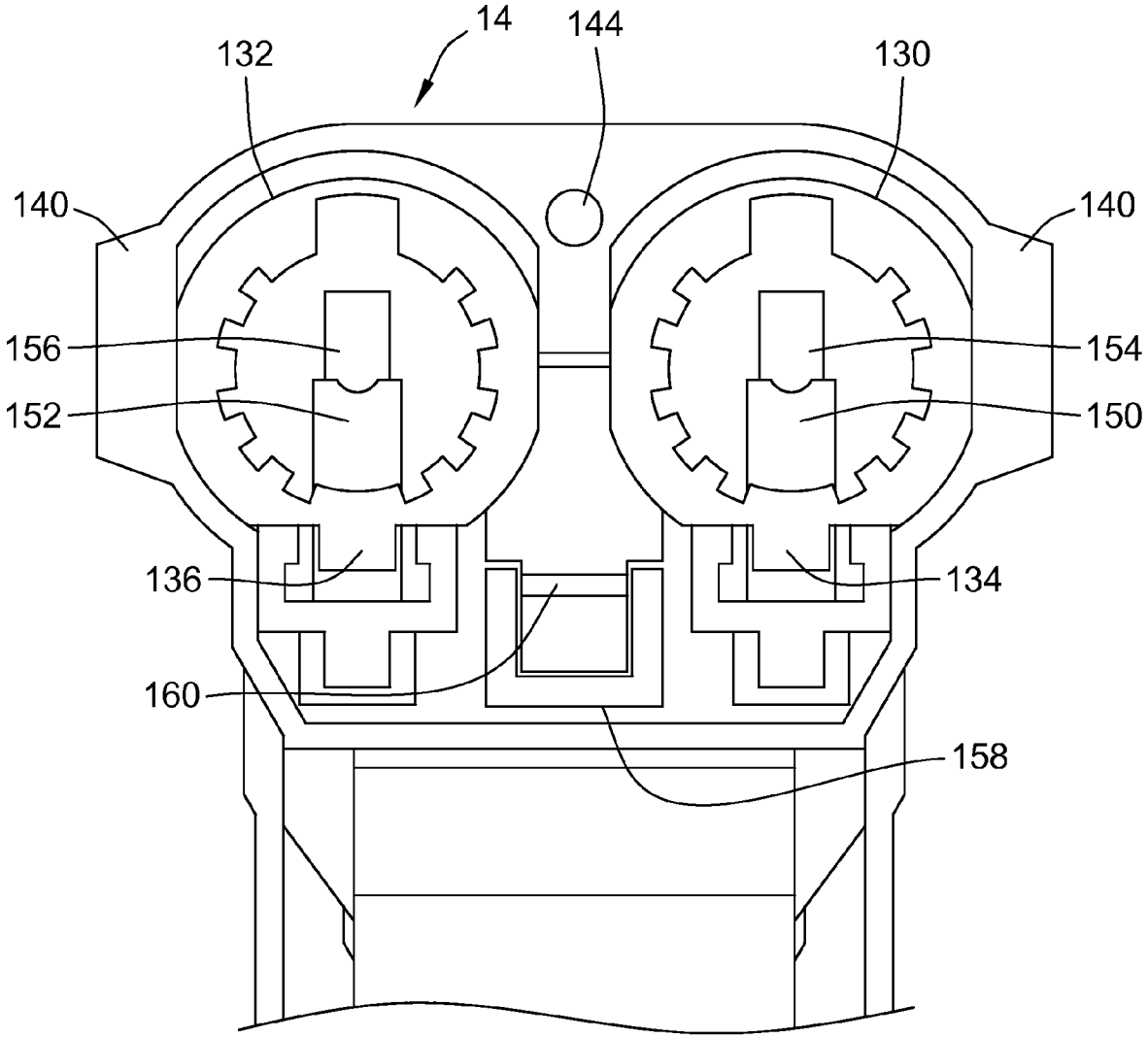
FIG. 8 is an enlarged rear elevation view of the barrels of the barrel assembly ready for loading.
Figure 19:
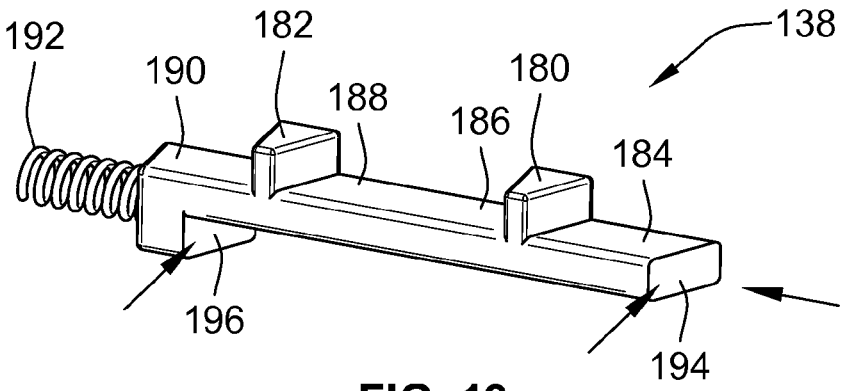
FIG. 19 is an enlarged isometric view of another portion of the lock mechanism.

Referring now to FIGS. 1 and 8-11, the barrel assembly 14 includes two barrels 130, 132, FIGS. 1 and 8, located in a side-by-side adjacent relationship. Each barrel includes a rear tab 134, 136, FIG. 8, a barrel assembly lock mechanism 138, FIGS. 11 and 19, a slide collar 140, a slide guide 142, a slide lock 144, a pivot fastener 146, a projectile guide 150, 152, FIGS. 8-10, for each barrel, a projectile retainer arm 154, 156 for each barrel, a mounting case 158, for the projectile guides and retainer arms, and a spring loaded retainer arm lever 160. The barrel assembly 14 is rotatably movable around the pivot fastener 146 relative to the housing 12 between a housing aligned position as shown in FIGS. 1-4, and a pivoted or housing nonaligned position as shown in FIG. 11.

Figure 16:
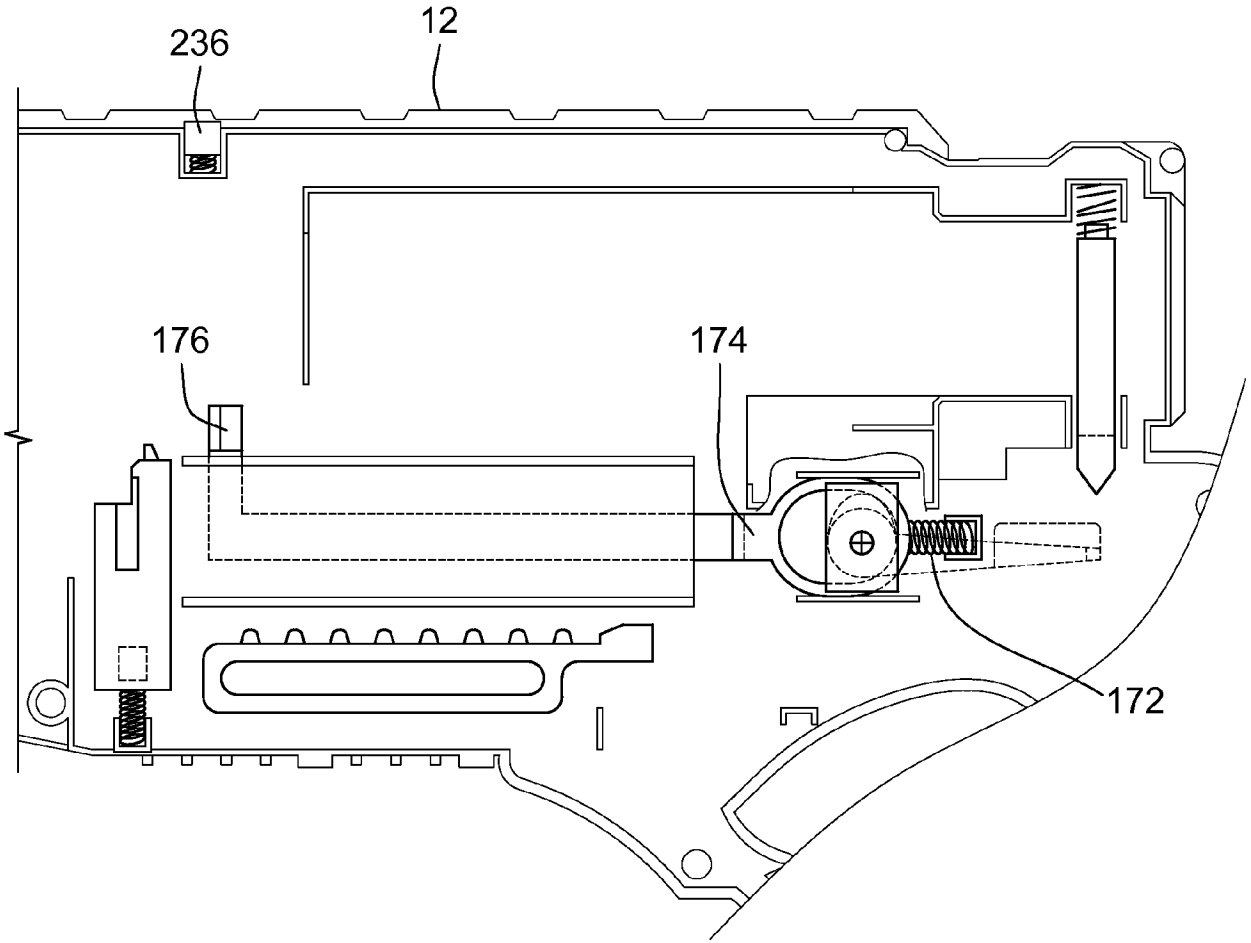
FIG. 16 is a partial side elevation view of a lever portion of a lock mechanism for maintaining the barrels locked to the housing of the toy launcher apparatus.
Figure 17:
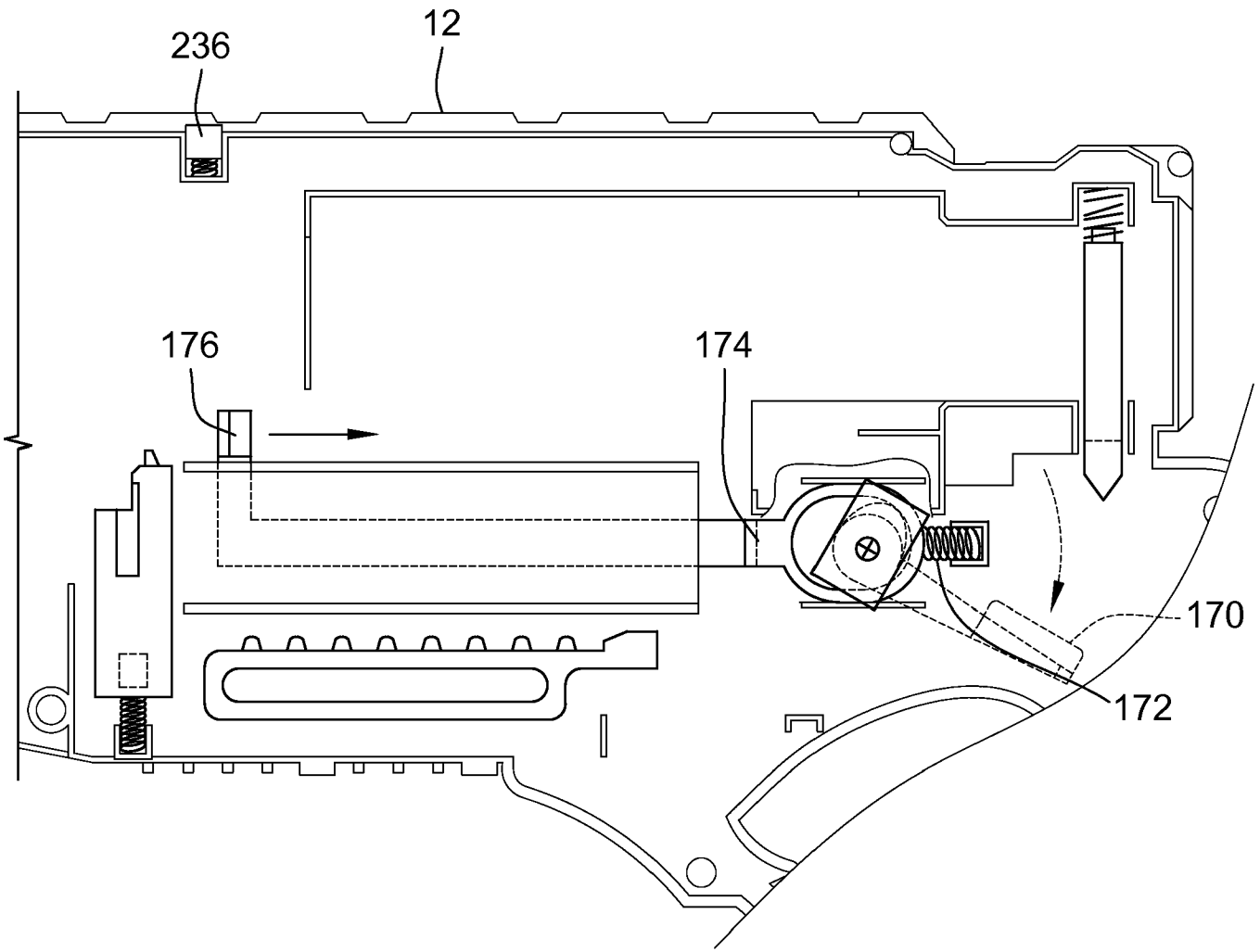
FIG. 17 is a partial side elevation view of the lever portion of the lock mechanism shown in FIG. 16, but with the lever moved to release the barrels from the housing.

When the barrel assembly 14 is in the housing aligned position, the barrels 130, 132 of the barrel assembly are movable between a retracted position as shown in FIGS. 3 and 4, and an extended position as shown in FIGS. 5 and 11. When the barrel assembly 14 is aligned with the housing 12 and the barrels are in the retracted position, the barrel assembly is locked to the housing by the barrel assembly lock mechanism 138. The barrel assembly lock mechanism 138 includes levers, such as the lever 170, FIGS. 1-3, mounted on one side of the housing, with each lever connected to a biasing spring, such as the biasing spring 172, FIGS. 16 and 17, also mounted to each side of the housing 12. Each lever 170 is connected to a forward extending arm, such as the extending arm 174, with a front cam surface, such as the front cam surface 176. Part of the lock mechanism 138, FIG. 19, includes a laterally movable bar 178 having raised surfaces 180, 182 to engage and capture the barrel rear tabs 134, 136, FIGS. 8-10. To each side of each raised surface are recesses 184, 186, 188, 190, FIG. 19. When the bar 178 is moved laterally, as shown by an arrow, that is, the bar is moved perpendicular to the longitudinal axis of the launcher apparatus, the tabs align with the recesses, and the barrels are released. A biasing spring 192 returns the bar 178 to its original position when the user releases the lever. Hence, when a lever 170, FIGS. 16 and 17, is rotated, the front cam surface 176 moves rearward to engage a slanted surface 194 or a slanted surface 196 (depending upon which of the two levers is rotated) of the bar 178, and slides the bar 178 horizontally to the right, causing the bar to disengage from the rear tabs 134, 136 of the barrels 130, 132 and thereby unlocking the barrel assembly from the housing.

Figure 9:
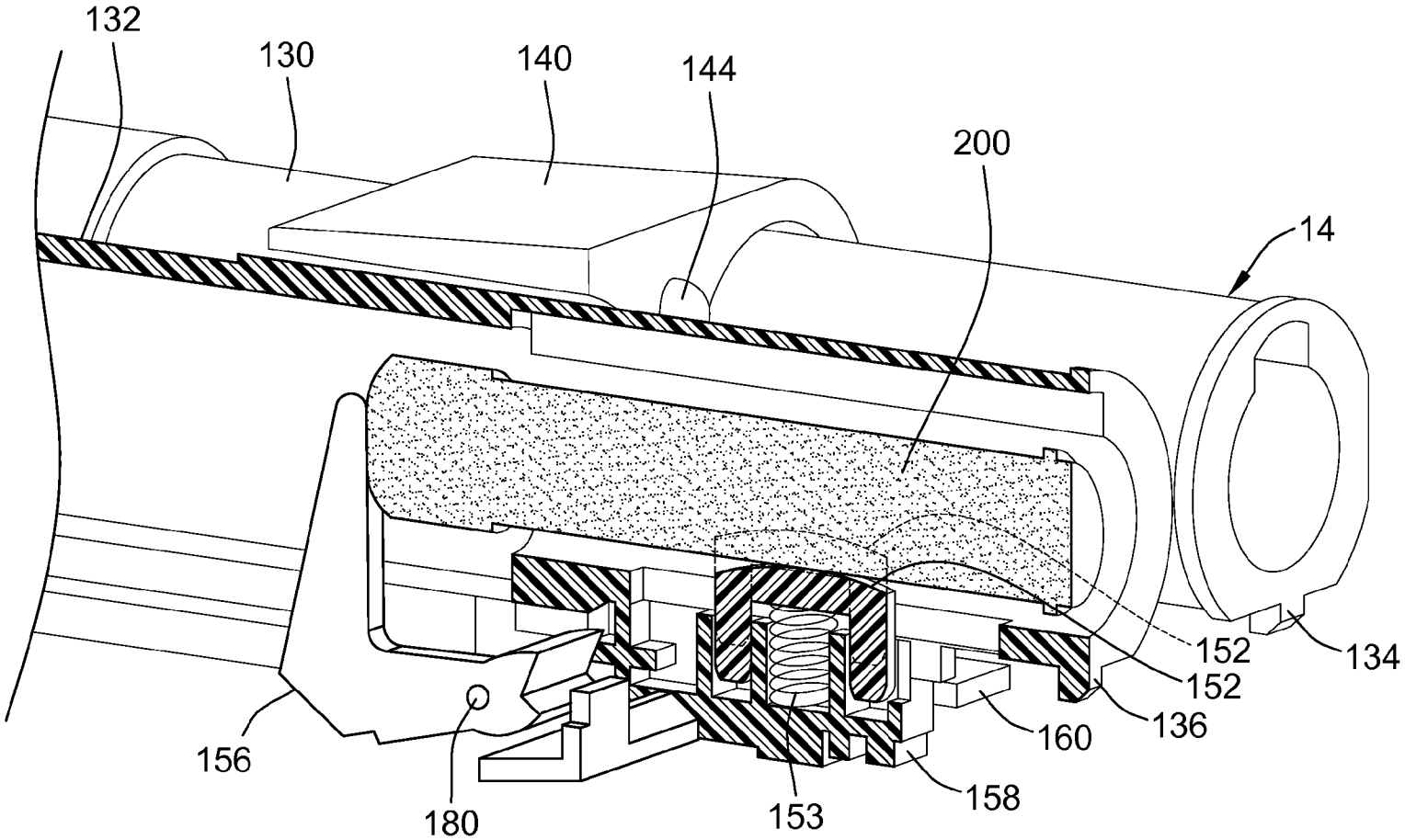
FIG. 9 is a partial isometric sectional view of the barrels illustrating a loaded projectile blocked by a retainer arm.

When the barrels 130, 132 are in the pivoted position shown in FIG. 11, projectiles may be loaded in each barrel, such as the projectile 200, FIG. 9, in the barrel 132. The barrels 130, 132 and the barrel assembly 40 must be returned to the retracted and aligned positions, respectively, as shown in FIGS. 1-4, before the loaded projectiles may be launched. The act of pivoting the barrel assembly, sometimes called "breaking" the barrel, and rotating the barrel assembly around the pivot fastener 146, FIG. 11, to the pivoted position, cocks the launcher apparatus 10 and positions the barrels to allow loading of projectiles. Returning the barrel assembly to a housing aligned position and retracting the barrels complete a cocking cycle. During movement of the barrels between the retracted and the extended positions, the barrels 130, 132 are facilitated by the slide guide 142, FIGS. 4 and 5, and the slide collar 140. During rotation of the barrel assembly, the barrels 130, 132 are held stationary by being locked to the slide collar 140 by the slide lock 144, FIGS. 9-11. In the locked configuration, the barrels are prevented from sliding from the extended position to the retracted position.

Figure 10:
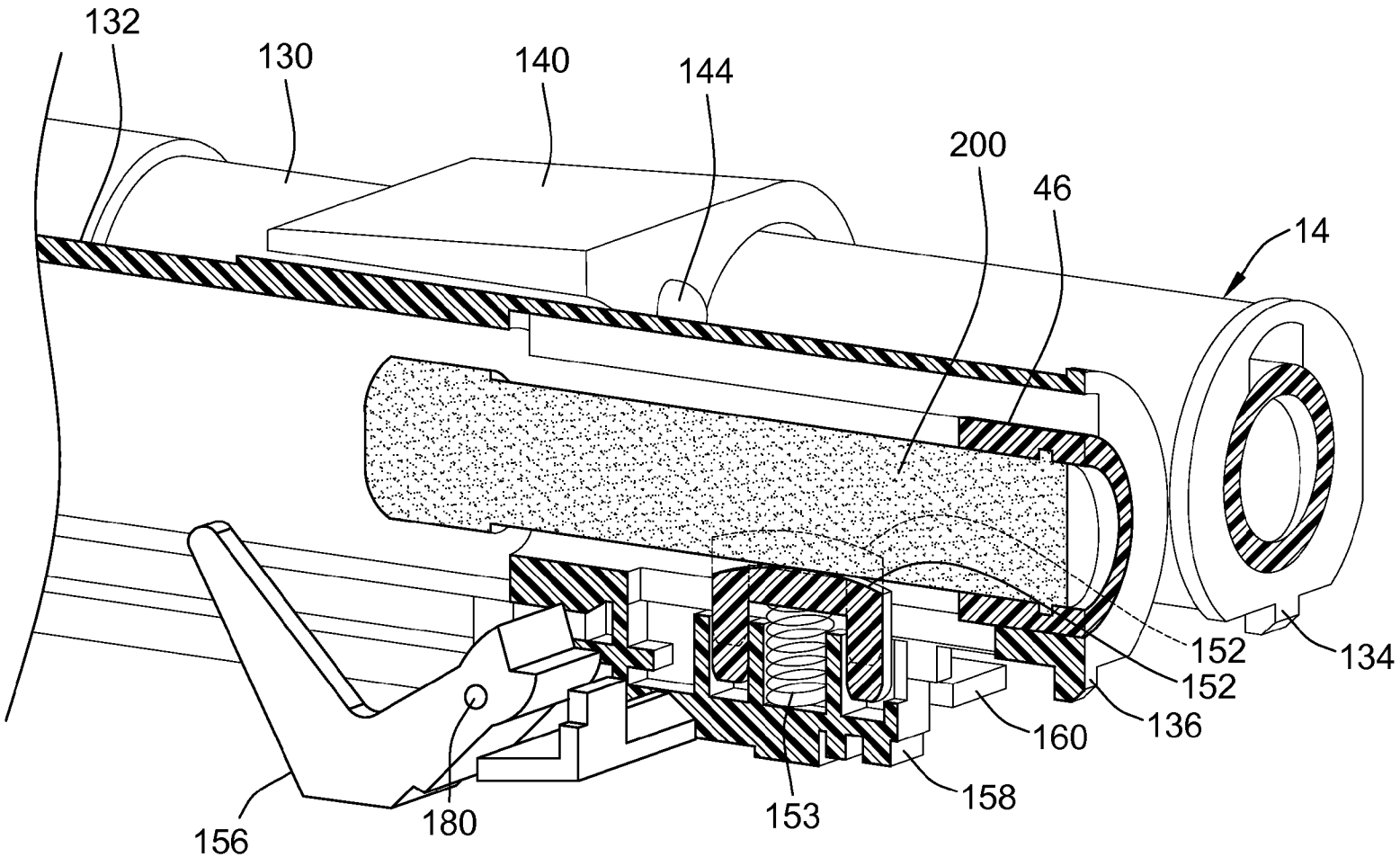
FIG. 10 is a partial isometric, sectional view of the barrels like that shown in FIG. 9, illustrating loaded projectiles ready to be fired and the retainer arm in an unblocked position.

In each barrel the respective projectile guide 150, 152 is always extended upward because of biasing from the guide springs, such as the guide spring 153, FIGS. 9 and 10, to ensure that each projectile is properly seated by being biased upward once loaded into the barrel. The projectile guides, being spring biased, allows different size projectiles to be used in the launcher apparatus, and/or projectiles with enlarged heads may be used. The enlarged head is able to pass beyond the projectile guide and yet the projectile guide is still able to bear against a smaller projectile body to ensure that each projectile is correctly located in the barrel so as to be aligned with the respective breech tube 46 when the barrel is retracted prior to discharge as shown in FIGS. 4 and 10. Each retainer arm 154, 156, one in each barrel, is in a predetermined barrel blocking position, as shown in FIG. 9, to also properly locate a projectile in the barrel. The retainer arms also prevent projectiles from simply sliding down and out of the barrels during loading. The projectiles are prevented from being pushed too deeply into the barrels because the heads of the projectiles will abut a respective retainer arm. Hence, the projectile guides and retainer arms guarantee that when a user loads projectiles they are both biased upward in the barrels and they are limited in forward movement into the barrels. When the barrels are refracted the projectile retainer arms push the loaded projectiles into the breech tubes. The projectile guides and retainer arms are supported by a mounting case 158 to the barrels and the mounting case also supports the lever 160 for rotating the retainer arms about a pivot 180.

The slide lock 144 locks the barrels 130, 132 to the slide collar 140 whenever the barrel assembly 14 is pivoted away from the housing 12. When the barrel assembly returns from the pivoted position to the aligned position, the slide lock 144 comes into contact with a first front surface 192, FIG. 11, of the frame member 30 and the slide lock is pushed inward (the forward direction as previously arranged and to the left as illustrated in FIG. 11) to release the barrels 130, 132. The released barrels may be pushed rearward by the user to slide the barrels 130, 132 from the extended position shown in FIGS. 5 and 11, to the retracted position shown in FIGS. 4 and 10. When the barrels are fully retracted, the barrels slide over their respective breech tubes, such as the breech tube 46, FIGS. 4 and 10, thereby loading the projectiles into the breech tubes, and the barrel rear tabs 134, 136 lock the housing aligned barrel assembly 14 to the lock mechanism 138. Returning the barrel assembly to the housing align position brings the lever 160 for the retainer arms into abutment with a second surface 194, FIG. 11, of the frame member 30 causing the retainer arms lever 160 to be pushed inward (as before, the forward direction in the drawing, FIG. 11) which causes the retainer arms 154, 156 to rotate from a barrel blocking position shown in FIGS. 8 and 9, to a barrel unblocking or reclined position shown in FIG. 10. Furthermore, when the barrels are fully retracted, the trigger assembly 16 is released from the forward latch ring 120 as shown in FIG. 4. The barrels and the mounting case may be made of any suitable plastic and the springs and pivot fastener may be made of any suitable material, such as a metal.

Referring now to FIGS. 6, 7 and 11, a cocking assembly 210 includes an elongated slightly curved link 212 pivotally connected at one end 214 to the barrel assembly 14 at the pivot fastener 146. At a second end 216, the elongated link 212 is pivotally connected to a ratchet and compression mechanism 218 at a pivot pin 220. The ratchet and compression mechanism 218 includes a central structure or block 222, an upper extending arm 224 connected to the central block 222 and a lower extending arm 226, also connected to the central block, as well as to a rack 228. The central block 222 and the rack 228 are mounted to the frame member 30. In turn, the frame member 30 is fastened to the housing 12. The central block 222 is moved by the elongated link 212 between two positions, a forward position shown in FIG. 5, and a rearward cocked position shown in FIGS. 7 and 11. A partially cocked position is shown in FIG. 6.

When the barrel assembly 14 is rotated by the user to the pivoted, nonaligned-with-the-housing position shown in FIGS. 11 and 12, the elongated link 212 is forced rearward causing the central block 222 to move to its rearward position as shown in FIGS. 7 and 11. During the rearward movement of the central block 222, the upper arm 224 engages the lower tab 52 of the launching tube 42 to move the launching tube rearward causing the launching spring 48 to compress between the flanges 54 and 84. Also during the rearward movement of the central block 222, the lower arm 226 moves along the rack 228 forming a ratchet, shown in sequence in FIGS. 6 and 7, so that a partially compressed launching spring is prevented from inadvertently snapping back to an expanded configuration causing the barrel assembly to snap upward should the user fumble the toy launcher apparatus. As used here, the term "ratchet" means that the lower arm 226 moves along the teeth of the rack 228 as the central block 222 is moved rearward. However, should the launching spring attempt to expand before the launching tube is captured, the central block will tilt because the front tab 52 bears against and pivots the upper arm 224. Pivoting the upper arm forces the lower arm into a space between two teeth of the rack and prevents any forward movement of the central block. Stopping the central block also stops the upper arm 224 and prevents forward movement of the launching tube 42 and the launching spring 48 because of the abutment between the surface 62 of the front tab 52 and the upper arm. When the barrel assembly 14 is fully rotated counterclockwise by the user, the launching spring 48 is in the cocked position, and the launching tube 42 is in the rearward or cocked position as shown in FIG. 7. With the launching tube in its cocked position, the rear hook 50 of the launching tube 42 abuts the rear latch ring 116 and is captured. Thereafter, when the user rotates the barrel assembly to its aligned position shown in FIG. 5, the central block 222 moves to its forward position. The elongated link and the ratchet mechanism may be made of any suitable plastic.

To complete the cocking procedure, when the barrel assembly is again aligned with the housing, the barrels 130, 132 are moved from the extended position, FIG. 5, to the retracted position, FIG. 4, causing the barrel assembly 14 to be locked to the housing 12, and the trigger assembly 16 to be released by the abutment of the mounting case 158 with the front latch ring 120, so that the trigger may be activated by the user to discharge previously loaded projectiles. It is now clear that the toy launcher apparatus is structurally robust, relatively simple to use, relatively inexpensive, compact, fun and safe for children.

Figure 18:
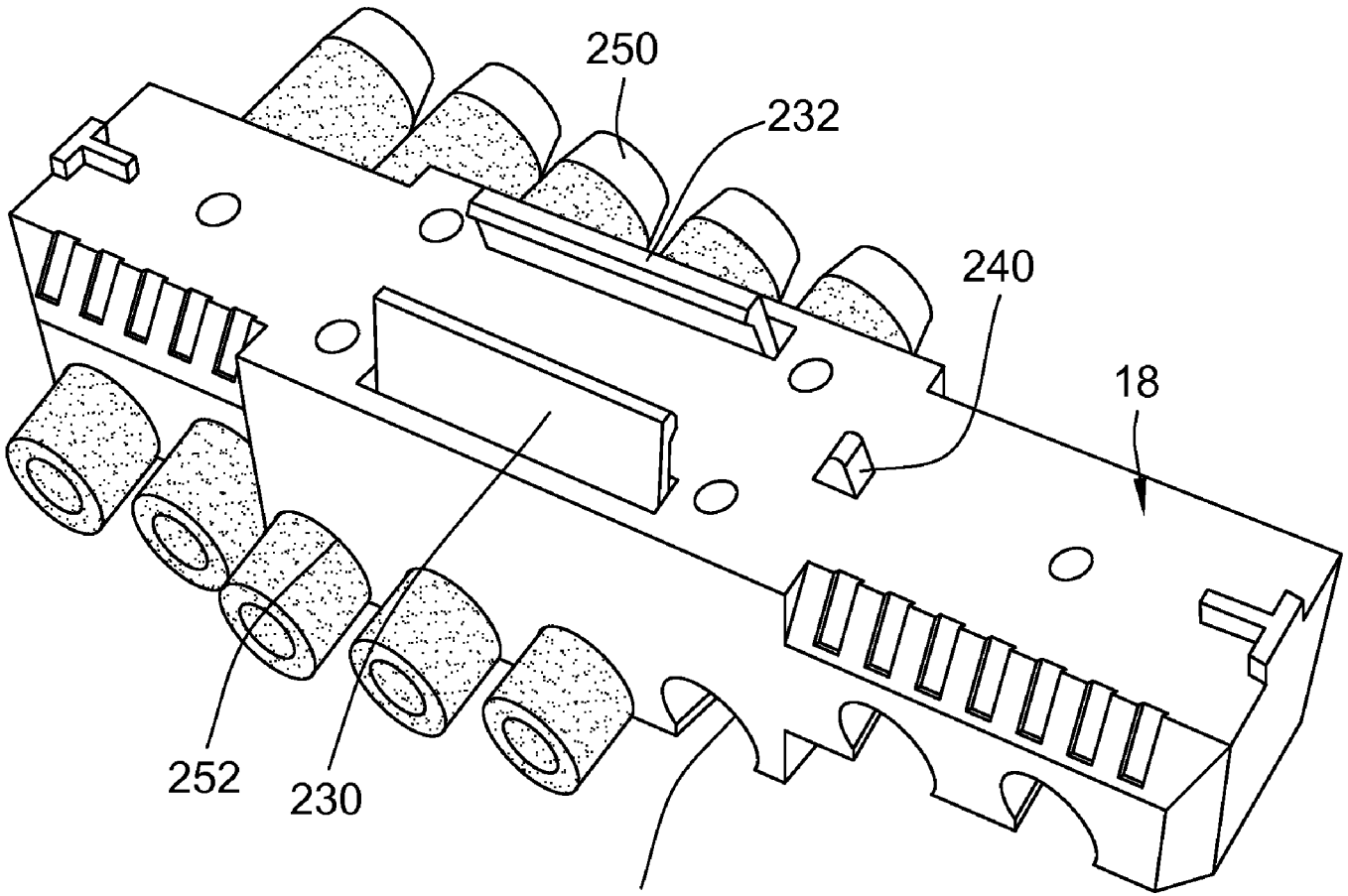
FIG. 18 is an enlarged, bottom isometric view of the projectile carrier.

The projectile carrier 18, FIGS. 2, 3 and 18, includes movable legs 230, 232 that are spring biased to easily engage a rail 234, FIGS. 1 and 3, formed in an upper portion of the housing 12. Also mounted to the housing 12 is a spring-biased barrier 236, FIG. 16, which allows the carrier 18 to be easily mounted to the housing, but, thereafter, a carrier tab 240, FIG. 18, engages the barrier 236 to prevent the carrier 18 from inadvertently disengaging from the housing 12. The barrier 236 is, however, easily overcome by the user should the user wish to disengage the carrier 18 from the housing 12 and use the toy launcher apparatus 10 without the carrier as shown in FIG. 1. The carrier 18 has a scalloped upper surface 242, FIG. 3, to receive a plurality of projectiles, one projectile in each of the depressions formed in the upper surface, such as the projectile 250 in the depression 252.

In the alternative, the various structures described above that are included as part of an assembly may be treated individually without regard to an "assembly", or the structures may be grouped in smaller assemblies or subassemblies. The use of assemblies here is for convenience and clarity. Also in the alternative, the toy launcher assembly may be designed to have one barrel over another barrel, or to have just a single barrel, or even more than two barrels. A still further alternative may comprise a different launching tube structure and latch ring arrangement as well as a different trigger assembly.

In operation of the toy launcher apparatus, a description of an operational cycle of the toy launcher apparatus begins with the apparatus in the configuration shown in FIGS. 1-3, loaded and ready to be discharged. The barrel assembly is aligned with the housing and the barrels are locked in the retracted position. Projectiles have been loaded in the breech tubes, and the launcher apparatus is ready to "fire" the projectiles. When a user pulls back on the trigger assembly, one or both launching springs are released and one or both launching tubes quickly move forward because of the expanding launching spring to provide pressurized air to one or both inner tubes and to one or both of the projectiles in the breech tubes. If the user pulls the trigger assembly fully rearward quickly both projectiles will be discharged almost together. If the user pulls the trigger assembly only part way than only one projectile will be discharged. Later, the user may pull the trigger assembly all the way and discharge the second projectile.

After the discharge, if the user wishes to reload and cock the launcher apparatus, one of the levers of the barrel assembly lock mechanism is rotated to disengage or unlock the barrel assembly from the housing, and the barrels are pulled from the retracted position to the extended position. Next, the user "breaks" the apparatus by rotating the barrel assembly counterclockwise as shown in FIG. 11, to the housing nonaligned position, also as shown in FIG. 11. The rotation of the barrel assembly cocks the apparatus by moving the launching springs and the launching tubes to their rearward positions using the link and the ratchet and compression mechanism. One or two projectiles are then inserted or loaded into the barrels. During cocking, the ratchet prevents an inadvertent snap back of the launching springs and the barrel assembly should the user momentarily lose control of the toy launcher apparatus. The user then closes the toy launcher apparatus by rotating the barrel assembly clockwise until the barrel assembly is again aligned with the housing. The slide lock disengages the barrels from the slide collar allowing the user to slide the barrels rearward to their retracted positions. When the barrels reach the retracted position, the barrel assembly becomes locked to the housing, the projectiles are pushed rearward to the breech tubes, the trigger assembly is unlocked, and the retainer arms pivot from the barrel blocking position to the barrel unblocking position to clear the barrels for discharge of the projectiles.

Figure 20:
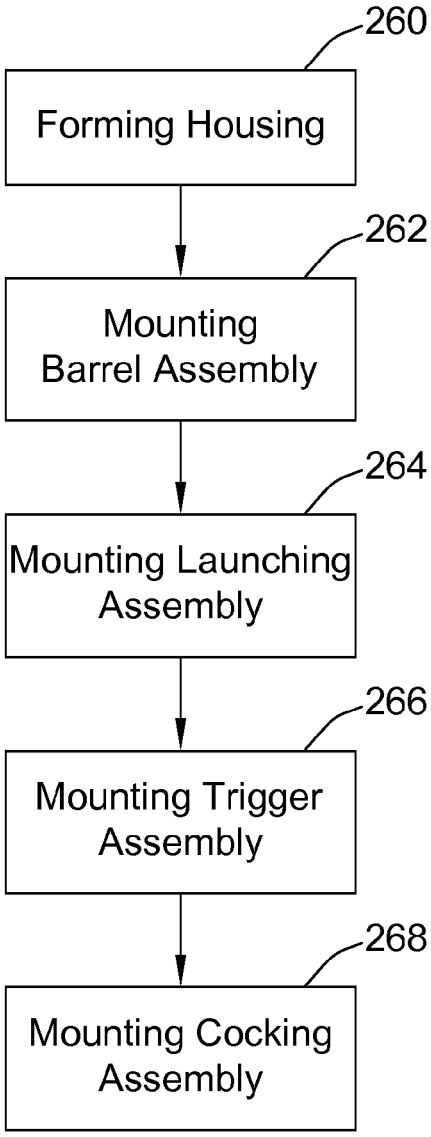
FIG. 20 is a flow diagram for a method of manufacturing the toy launcher apparatus.

The present invention also includes a method for manufacturing the toy launcher apparatus including the steps of forming 260, FIG. 20, the housing with an inner frame, pivotally mounting 262 the barrel assembly to the housing, the barrel assembly being movable between the housing aligned position and the housing unaligned position, and when in the housing aligned position, the barrels are slidable between the retracted position and the extended position, mounting or installing 264 the launching assembly to the housing, the launching assembly including the launching tube and the launching spring, mounting or connecting 266 the trigger assembly to the housing to enable the launching tube to be captured and, thereafter, released by the user, and mounting 268 the cocking assembly to the housing including installing the ratchet and compression mechanism to the inner frame in the housing. The cocking assembly is pivotally connected to the barrel assembly and operatively connected to the launching structure to enable a user of the toy launcher apparatus to discharge one or two projectiles, as desired, and with the ratchet and compression mechanism, safely prevents the inadvertent expansion of the launching spring.

The toy launcher apparatus disclosed in detail above has great play value, is fun to use and easy to operate because it simulates in appearance a real shotgun and generally operates like one, but does so safely, and with a robust, but simple structure, that is produced at reasonable cost.

From the foregoing, it can be seen that there has been provided features for an improved toy apparatus that simulates a real shotgun and a disclosure of the method of the toy's manufacture. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launcher apparatus comprising:

a housing;

a barrel assembly pivotally mounted to the housing, the barrel assembly having two adjacent barrels with each barrel enabled to receive a toy projectile, the barrel assembly being rotatable between a housing aligned position and a housing nonaligned position;

a slide collar connected to the barrels, the barrels being movable relative to the slide collar between a retracted position and an extended position when the barrel assembly is in the housing aligned position;

a launching assembly connected to the barrel assembly, the launching assembly including a launching spring;

a trigger assembly mounted to the housing and connected to the launching assembly, the trigger assembly having structure to capture and release the launching assembly;

a ratchet and compression mechanism mounted to the housing; and a cocking assembly connected to the barrel assembly and to the launching assembly, the cocking assembly using the ratchet and compressing mechanism to safely compress the launching spring of the launching assembly to enable the toy projectiles to be discharged from the barrels.

2. The toy launcher apparatus of claim 1 wherein:

the ratchet and compression mechanism includes a central block pivotally connected to the barrel assembly, first and second arms extending from the central block, and a rack mounted to the housing, the first arm compresses the launching spring, and the second arm and the rack form a ratchet to prevent a partially compressed launching spring from inadvertently expanding.

3. The toy launcher apparatus of claim 1, wherein:

the cocking assembly includes an elongated link pivotally connected to the barrel assembly and to the ratchet and compression mechanism.

4. The toy launcher apparatus of claim 1, wherein:

the barrel assembly includes a projectile retainer arm movable between a barrel blocking position and a barrel unblocking position.

5. The toy launcher apparatus of claim 1, wherein:

the barrel assembly includes a slide lock mounted to the slide collar to prevent movement of the barrels relative to the slide collar.

6. The toy launcher apparatus of claim 1, including:

a lock mechanism to prevent rotation of the barrel assembly relative to the housing.

7. The toy launcher apparatus of claim 1, wherein:

the ratchet and compression mechanism includes a central block pivotally connected to the barrel assembly, first and second arms extending from the central block, and a rack mounted to the housing, the first arm being located to compress the launching spring, and the second arm and the rack forming a ratchet to prevent a partially compressed launching spring from inadvertently expanding; and the cocking assembly includes the ratchet and compression mechanism and an elongated link pivotally connected to the barrel assembly and to the ratchet and compression mechanism.

8. The toy launcher apparatus of claim 7, wherein:

the barrel assembly includes a projectile retainer arm in each of the barrels, each projectile retainer arm being movable between a barrel blocking position and a barrel unblocking position.

9. The toy launcher apparatus of claim 8, wherein:

the barrel assembly includes a slide lock mounted to the slide collar to prevent movement of the barrels relative to the slide collar.

10. The toy launcher apparatus of claim 9, including:

a lock mechanism mounted to the housing located to prevent rotation of the barrel assembly relative to the housing.

11. The toy launcher apparatus of claim 1, wherein:

the barrel assembly includes a projectile retainer arm in each of the barrels, each of the projectile retainer arms being movable between a barrel blocking position and a barrel unblocking position; and the barrel assembly includes a slide lock.

12. The toy launcher apparatus of claim 11 wherein:

the ratchet and compression mechanism includes a central block pivotally connected to the barrel assembly, first and second arms extending from the central block, and a rack mounted to the housing, the first arm for compressing a launching spring, and the second arm and the rack forming a ratchet to prevent a partially compressed launching spring from inadvertently expanding.

13. A toy launcher apparatus comprising:

a housing;

a barrel assembly pivotally mounted to the housing, the barrel assembly having a barrel, and the barrel assembly being movable between a housing aligned position and a housing nonaligned position;

a slide collar connected to the barrel, the barrel being slidable between a retracted position and an extended position when the barrel assembly is in the housing aligned position;

a launching assembly connected to the barrel assembly, the launching assembly including a launching spring;

a trigger assembly mounted to the housing and connected to the launching assembly, the trigger assembly having structure to captured and released the launching assembly;

a ratchet and compression mechanism mounted to the housing; and a cocking assembly including the ratchet and compression mechanism connected to the barrel assembly and to the launching assembly to safely compress the launching spring to enable a toy projectile to be discharge from the barrel.

14. The toy launcher apparatus of claim 13, wherein:

the cocking assembly includes an elongated link pivotally connected to the barrel assembly and to the ratchet and compression mechanism; and the ratchet and compression mechanism includes a central block pivotally connected to the barrel assembly, first and second arms extending from the central block, and a rack mounted to the housing, the first arm located to compress the launching spring of the launching assembly, and the second arm and the rack forming a ratchet.

15. The toy launcher apparatus of claim 14, wherein:

the barrel assembly includes a projectile retainer arm mounted to the barrel pivotal between a barrel blocking position and a barrel unblocking position.

16. The toy launcher apparatus of claim 15, wherein:

the barrel assembly includes a slide lock mounted to the slide collar located to prevent movement of the barrel relative to the slide collar.

17. The toy launcher apparatus of claim 16, including:

a lock mechanism mounted to the housing to prevent rotation of the barrel assembly relative to the housing.

18. A method for manufacturing a toy launcher apparatus comprising the steps of:

forming a gun simulating housing with an inner frame;

pivotally mounting a barrel assembly to the housing, the barrel assembly being movable between a housing aligned position and a housing nonaligned position;

slidably mounting multiple barrels of the barrel assembly to a slide collar, the barrels being movable between a retracted position and an extended position when the barrel assembly is in the housing aligned position;

installing a launching assembly to the inner frame of the housing operatively connected to the multiple barrels, the launching assembly including a launching tube and a launching spring;

connecting a trigger assembly to the housing located to capture and release the launching tube and the launching spring;

installing a ratchet and compression mechanism to the inner frame in the housing; and mounting a cocking assembly to the housing, the cocking assembly including the ratchet and compression mechanism, and being pivotally connected to the barrel assembly and to the ratchet and compression mechanism, the cocking assembly movable to safely compress the launching spring.

19. The method of claim 18 wherein the step of:

mounting the cocking assembly includes the steps of pivotally connecting one end of a link to the barrel assembly and pivotally connecting a second end of the link to the ratchet and compression mechanism, the ratchet and compression mechanism including a central structure having upper and lower extending arms and a rack; and including the step of engaging the upper arm with the launching assembly and the lower arm with the rack.

20. The method of claim 19 wherein the step of:

mounting the barrel assembly includes the step of pivotally mounting a projectile retainer arm in each of the multiple barrels, each projectile retainer arm being movable between a barrel blocking position and a barrel unblocking position.

* * * * *